United States Patent [19]

Tani

[11] Patent Number: 4,629,071

[45] Date of Patent: Dec. 16, 1986

[54] EASY-TO-OPEN BAG

[76] Inventor: Kanari Tani, 70 4-chome, Minamigaoka, Onojo-shi, Fukuoka, Japan

[21] Appl. No.: 770,566

[22] Filed: Aug. 29, 1985

[51] Int. Cl.[4] ..... B65D 27/38; B65D 65/34

[52] U.S. Cl. ..... 206/618; 206/605; 206/616; 206/617; 206/632

[58] Field of Search ..... 206/484, 610, 616, 618, 206/632, 617, 601, 605, 607, 633

[56] References Cited

U.S. PATENT DOCUMENTS

| | | | |
|---|---|---|---|
| 1,093,695 | 4/1914 | Grizzard | 206/618 |
| 1,930,299 | 10/1933 | Adams | 206/618 |
| 2,852,179 | 9/1958 | Bieler | 206/616 |
| 3,057,539 | 10/1962 | Leary, Jr. | 206/618 |
| 3,266,965 | 8/1966 | Spees | 206/616 |
| 3,276,669 | 10/1966 | Vilutis | 206/616 |
| 3,494,538 | 2/1970 | Matthews | 206/616 |

FOREIGN PATENT DOCUMENTS

| | | | |
|---|---|---|---|
| 570095 | 6/1945 | United Kingdom | 206/618 |

*Primary Examiner*—Joseph Man-Fu Moy
*Assistant Examiner*—David T. Fidei
*Attorney, Agent, or Firm*—Jordan and Hamburg

[57] ABSTRACT

An easy-to-open bag of this invention is characterized by having a tear string heat-fused to the inside of one of the walls and a pulling tab which is defined by a U-shaped score and an adjacent transverse opening both formed in the heat-sealed border region of the bag.

Due to such construction, the pulling tab can be readily picked up and then the tear string is pulled linearly to tear away the bag and form the opening without fail.

8 Claims, 8 Drawing Figures

EASY-TO-OPEN BAG

BACKGROUND OF THE INVENTION

The present invention relates to an easy-to-open bag made of a synthetic resin.

Conventionally there have been proposed various kinds of easy-to-open bags which can be readily opened by breaking the bag with a tear string.

U.S. Pat. No. 3,057,539 discloses a pouch having a string buried between the polyethylene coating and the substrate to which the extruded polymer is applied. The polyethylene lamina usually faces the interior of the pouch.

Due to such construction, when the string is pulled to open the pouch, the polyethylene coating remains intact and has to subsequently be pulled apart by hand in order to get to the contents of the pouch.

For resolving the above defects, U.S. Pat. No. 3,494,538 discloses an easy-to-open bag or container, wherein the bag comprises a lamina of polyethylene and a fibrous tear string securely embedded in the surface of the lamina which faces the interior of the bag and the tear string is impregnated with dewaxed shellac.

Due to such construction, the string adheres to the polyethylene securely.

However, since the string adheres to the polyethylene by compression of pressure rolls with the exception of heat-sealed perimeters, the adhering strength is still less than optimal. Therefore, the tear string cannot tear the bag sharply. Furthermore, dewaxed shellac contaminates the content of the bag.

Still furtheremore, in the U.S. Pat. No. 3,494,538, since the notches or slits are formed by cutting the outermost edge of the heat-sealed perimeters to form a pulling tab, the perimeter is destroyed considerably so that the bag cannot be used for any other usages after opening.

Accordingly, it is an object of the present invention to provide an easy-to-open bag which can obviate the above defects of the conventional bags.

SUMMARY OF THE INVENTION

In summary, the present invention discloses an easy-to-open bag which is characterized by having a tear string which is formed by fixedly and concentrically adhering the outer heat-fusing layer on the core string and a pulling tab which is defined by a U-shaped score and an adjacent transverse opening both formed in the heat-sealed border of the bag.

DETAILED DESCRIPTION OF PREFERRED EMBODIMENTS

Figure 1:
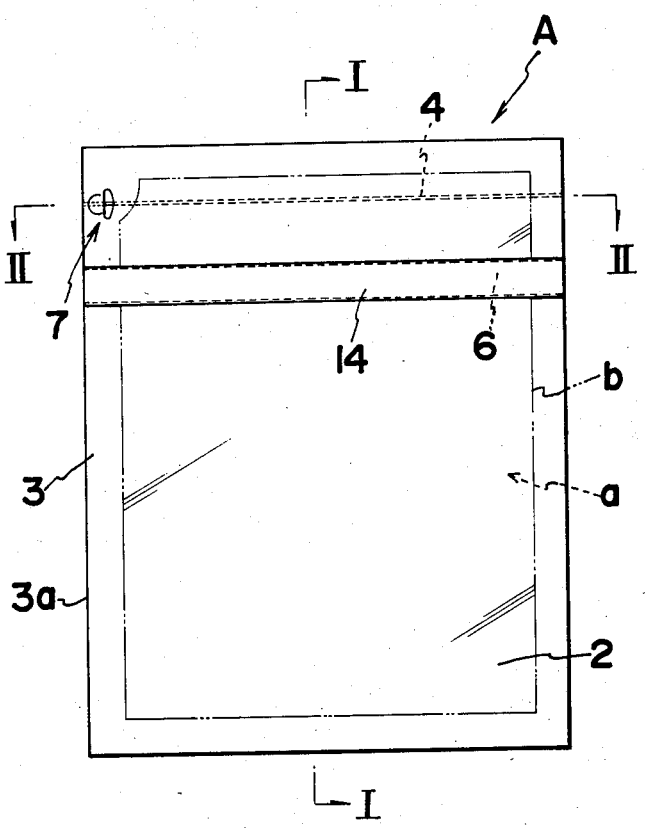
FIG. 1 is an elevational view of an easy-to-open bag of the present invention.
Figure 2:
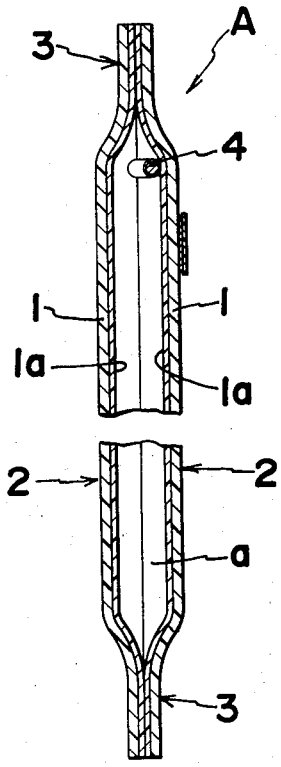
FIG. 2 is a cross-sectional view taken along the line I—I of FIG. 1.
Figure 3:
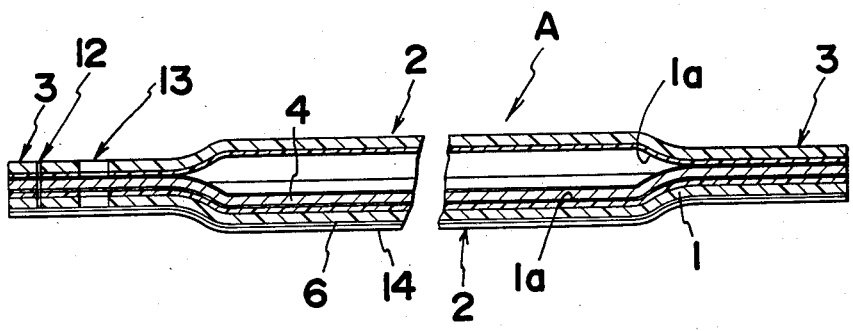
FIG. 3 is a cross-sectional view taken along the line II—II of FIG. 1.

The present invention is described in detail hereinafter in conjunction with following preferred embodiments.

In FIG. 1 to FIG. 4, A indicates a rectangular bag body made of synthetic resin. The bag body A is produced by overlapping or superposing a pair of laminated walls 2, 2, each wall 2 being constructed by laminating a desired number of synthetic resin film 1, 1*a*, heat-sealing the entire peripheries of the overlapped laminated walls 2, 2 to form a rectangular sealed border region 3, thus defining an unsealed interior a in the bag body A.

Letter b indicates a border line between the sealed border region 3 and the unsealed interior a.

A tear string 4 is provided on the upper portion of the inner side of one laminated wall 2. The tear string 4 extends in a transverse direction of the bag body such that both ends of the tear string 4 terminates at outer edges 3*a* of the sealed border region 3 of the bag body A.

Figure 7:
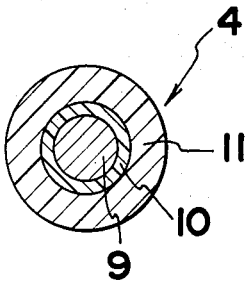
FIG. 7 is a transverse cross-sectional view of a tear string of the bag of FIG. 1.

The inner structure of the tear string 4 is shown in FIG. 7.

The tear string 4 has a triplicate concentirc construction which comprises an inner core string 9, an intermediate adhering agent layer 10 and an outer heat sealing or fusing layer 11, wherein the heat-fusing layer 11 is fixedly secured to the core string 9 by means of the intermediate adhering agent layer 10.

The core string 9 is preferably made of polyester and preferably has a circular cross section.

The adhering agent layer 10 is formed by coating neoprene on the core string 9.

The heat-fusing layer 11 is preferably made of a polypropylene and is concentrically provided on the adhering agent layer 10.

The core string 9 also can have other cross-sections such as an elliptical cross section, a polygonal cross section or splines on the outer surface thereof.

The adhering agent layer 10 may be nitrile rubber made of epoxy-poly-amide.

The heat-fusing layer 11 may be made of polypropylene, or copolymer of polyethylene and polypropylene.

The tear string 4 is fixedly secured to the laminated wall 2 of the bag body A by fusing the entirety of the outer heat-fusing layer 11.

A pulling tab 7 is disposed at one lateral side of the sealed border region 3 where one end of the tear string 4 terminates.

The pulling tab 7 is substantially a part of the sealed border region 3 defined by a U-shaped score 12 spaced apart from the outer edge of the sealed border region 3 of the bag body A and a transverse opening 13 disposed adjacent to the score 12 and close to the interior a of the bag body A.

The U-shaped score 12 is provided at one lateral side of the sealed border region 3 where one end of the tear string 4 is disposed.

Such score 12 consists of a round cut 12*a* which is spaced apart from the outer edge of the lateral side of the sealed border region 3 and a pair of side cuts 12*b*, 12*b* symmetrically disposed at both sides of the tear string 4.

The inner ends of the side cuts 12*b*, 12*b* should preferably be slightly inclined to the tear string 4 for providing the safe connection with the opening 13 when the pulling tab 7 is pulled.

Figure 4:
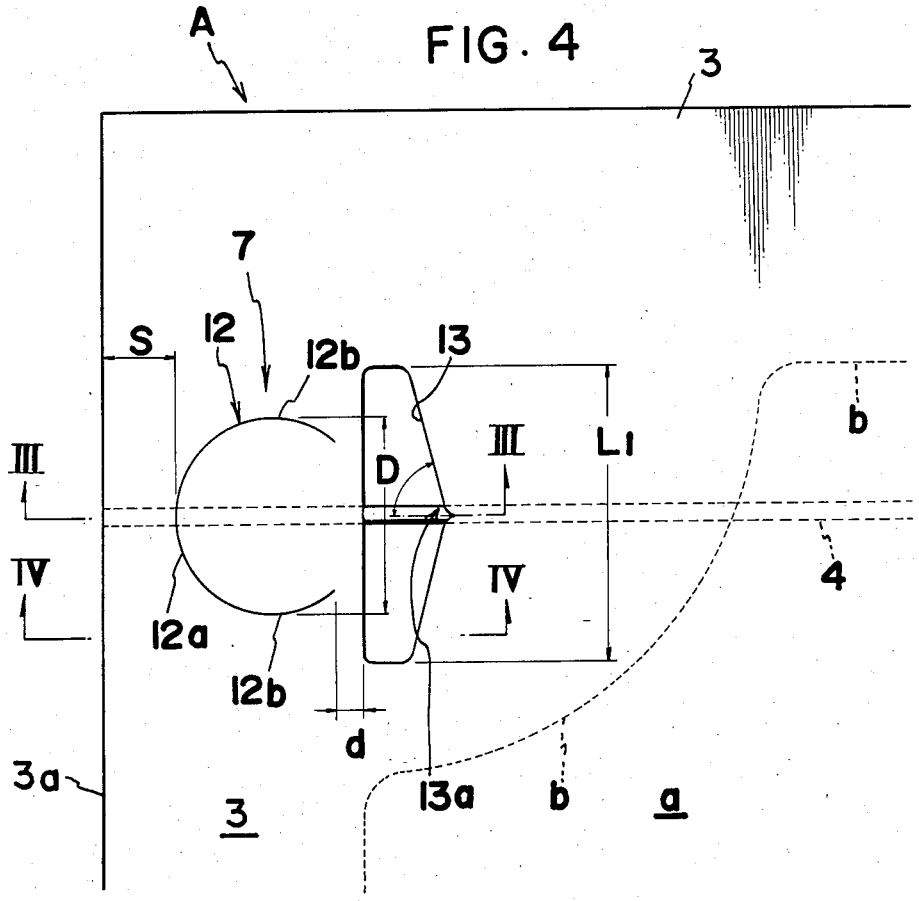
FIG. 4 is an enlarged partial view of the bag of FIG. 1.

The opening 13, as best shown in FIG. 4, extends transverse to the length of the tear string 4 between the inside of the bag body A and the inner ends of the side cuts 12*b*, 12*b* of the score 12. The tear string 4 passes through the central portion of the opening 13.

The opening 13 has a length L1 transverse to the tear string 4 far greater than the distance D between the inner ends of the side cuts 12*b*, 12*b* of the score 12 so that when the pulling tab 7 is pulled upwardly, the inner ends of the side cuts 12*b*, 12*b* can accurately reach to the opening 13 without fall.

Furthermore, the opening 13 has an inner convergent edge 13*a* closest to the interior a of the bag body A and located on the tear string 4. The inner convergent edge 13*a* making an angle $\alpha$ of less than 90° with the tear string 4 measured from the opening edge toward the interior of the bag body A. Due to such construction, the tear string 4 is always guided on a line of opening 13.

The end of the tear string 4 is connected to the pulling tab 7 such that the end is sandwiched between the laminated walls 2, 2 at the sealed border region 3.

As shown in FIG. 1, an adhesive band 6 transverses the bag body A parallel to and below the tear string 4. The band 6 has the rear surface thereof heat sealed to the bag body A and the front surface thereof provided with an adhensive face on which a peel-off paper 14 overlaps.

Figure 8:
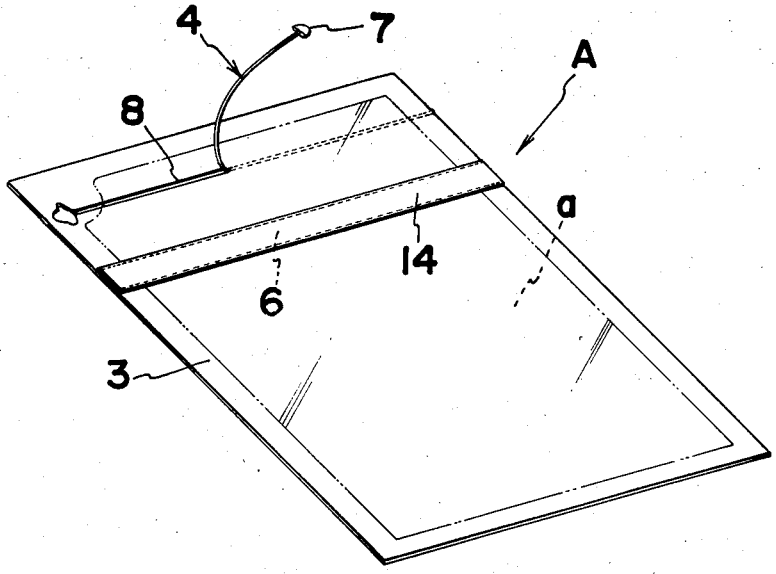
FIG. 8 is a schematic view of the bag of FIG. 1.

The manner in which the bag of this invention is opened is hereinafter disclosed in view of FIG. 4 and FIG. 8.

To open the bag, the pulling tab 7 is to be separated from the sealed border region 3. Such separation can be easily effected with the tab arrangement of this invention.

Figure 5:
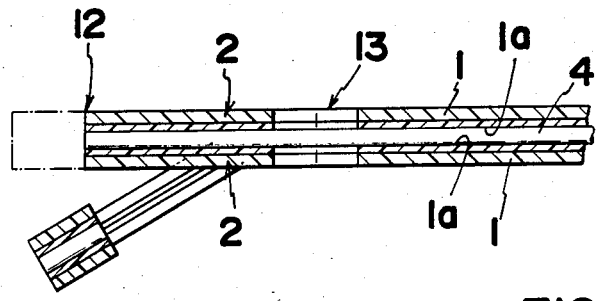
FIG. 5 is a cross-sectional view of FIG. 4 taken along the line III—III of FIG. 4.
Figure 6:
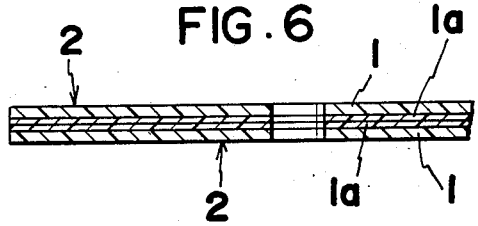
FIG. 6 is a cross-sectional view of FIG. 4 taken along the line IV—IV of FIG. 4.

Namely, as shown in FIG. 5 and FIG. 6, when the sealed border region 3 around the score 12 is folded downwardly relative to the sealed border region 3 defined by the score 12 and the unsealed portion of the bag body A, the pulling tab 7 protrudes in a transverse direction so that the pulling tab 7 can be easily pinched by fingers.

Then, the pulling tab 7 is further removed from the sealed border region 3 and is pulled in a direction toward the other end of the tear string 4 so that the tear string 4 first tears the portion d between the score 12 and the opening 13 and then, guided by the convergent edge 13*a*, the tear string 4 tears the bag body A along the opening line to provide the opening 8.

Since the removal of the outer heat fusing layer 11 from the core string 19 is completely prevented by the presence of the adhering agent layer 10, the opening of the bag body A is effected without fail.

If desired, after breaking the bag body A by pulling the tear string 4, to form a slit-like opening 8 (shown in FIG. 8), the peel-off paper 14 is peeled off to expose the adhesive face of the adhesive band 6 and the portion of the above the sealing band 6 is folded and compressed to the adhesive face of the sealing band 6 to readily close the bag body A.

According to this invention, since the tear string is constructed by fixedly and concentrically adhering the heat-fusing layer on the surface of the core string by way of the intermediate adhering agent layer, and such tear string is heat-sealed to the inner surface of the synthetic-resin made bag along an opening line, the removal of the core string from the heat-fused layer can be prevented thus assuring the sharp and complete opening of the bag without fail.

What we claim is:

1. An easy-to-open synthetic resin bag comprising:

(a) a bag body made of a pair of opposed walls, each wall formed from a plurality of layers of synthetic resin film, said walls being sealed together by heat around the periphery thereof to form a sealed border region around an unbonded interior of the bag, (b) a tear string heat-fused to the inside surface of one of said walls through the entire length thereof, said tear string including a core string and an outer heat-fusing layer fixedly and concentrically adhered to said core string, said tear string extending along a line corrsponding to a transverse opening to be formed in said bag, said tear string having one end extending into said border region and fused in said border region between said two walls, (c) a U-shaped score formed on said border region at a position disposed on said end of said tear string, said score including a round cut thereof spaced apart from an outer edge of said border region and a pair of side cuts symmetrically disposed at both sides of said tear string, said score having inner ends of said side cuts terminating in said border region at a location spaced outwardly of the unfused interior of said bag, (d) an opening formed in said border region extending transverse to the length of said tear string and between the inside of said bag and the inner ends of said side cuts of said score such that said tear string passes through the width of said opening, said opening being adjacent to, but slightly spaced from said inner ends of said side cuts of said score, said opening defining a pulling tab in said border region together with said U-shaped score, said opening having a length transverse to said tear string far greater than the distance between inner ends of said side cuts of said U-shaped score, said opening having an inner convergent edge closest to the interior of said bag and disposed on said tear string, said inner convergent edge making an angle $\alpha$ of less than 90° with said tear string measured from the opening edge toward the interior of said body.

2. An easy-to-open synthetic resin bag according to claim 1, wherein said outer heat-fusing layer is fixedly and concentrically adhered to the outer surface of said core string by means of an intermediate adhering agent layer.

3. An easy-to-open synthetic resin bag according to claim 1 wherein said core string is made of polyester.

4. An easy-to-open synthetic resin bag according to claim 1, wherein said adhering agent layer is made of a material selected from a group consisting of neoprene, nitrile rubber, and epoxy-poly-amide.

5. An easy-to-open synthetic resin bag according to claim 1, wherein said heat-fusing layer is made of a material selected from a group consisting of polypropylene, and a copolymer of polyethylene and polypropylene.

6. An easy-to-open synthetic resin bag comprising:

a bag body including a pair of opposed walls, each wall being formed of a plurality of layers of synthetic resin film and sealed against the other around the periphery thereof to form a sealed border region around the bag body with an unbonded interior, a tear string adhered to the inside surface of one of said walls, said tear string having at least one end portion extending throughout said border region and adhered between said two walls, said tear string extending substantially through the entire length of the bag along a line corresponding to a transverse opening to be formed in the bag, a score formed on said border region slightly away from an end of the walls, said score passing entirely through the walls and the tear string in the direction perpendicular to the tear string so that the tear string is dividing to an outside portion and a pulling portion, said score including a round cut and a pair of side cuts with inner ends symmetrically disposed at both sides of said tear string, and an opening formed in said border region of the walls adjacent to the inner ends of the side cuts of the score, said opening extending perpendicularly to the longitudinal direction of the tear string so that the tear string substantially passes through the center of the opening, whereby the sealed border region surrounded by the score and the opening forms a pulling tab which can be easily held by fingers by pushing the outside portion of the tear string downwardly when in use.

7. An easy-to-open synthetic resin bag according to claim 6, in which length of the opening perpendicular to the longitudinal direction of the tear string is greater than the distance between the inner ends of the side cuts of the score, said opening having an inner convergent edge less than 180 degrees at a position away from the score so that a wall can be easily torn at a proper position by means of the tear string by pulling the pulling tab.

8. An easy-to-open synthetic resin bag according to claim 7, in which said tear string comprises a core string, an intermediate adhering agent around the core string and an outer heat-fusing layer around the intermediate adhering agent so that the outer heat-fusing layer can be securely adhered to the core string.

* * * * *